US009025990B2

(12) United States Patent
Schlumm et al.

(10) Patent No.: US 9,025,990 B2
(45) Date of Patent: May 5, 2015

(54) PRINTER VAPOR TREATMENT PREHEATING

(75) Inventors: Doron Schlumm, Kfar Harif (IL); Sharon Nagler, Gan Yavna (IL); Eyal Peleg, Zoran (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 11 days.

(21) Appl. No.: 13/879,666

(22) PCT Filed: Nov. 1, 2010

(86) PCT No.: PCT/US2010/055011

§ 371 (c)(1), (2), (4) Date: Apr. 16, 2013

(87) PCT Pub. No.: WO2012/060815

PCT Pub. Date: May 10, 2012

(65) Prior Publication Data

US 2013/0216254 A1 Aug. 22, 2013

(51) Int. Cl.

| | |
|---|---|
| ***G03G 21/20*** | (2006.01) |
| ***B41J 11/00*** | (2006.01) |
| ***B41J 29/377*** | (2006.01) |

(52) U.S. Cl.

CPC ..... *G03G 21/20* (2013.01); *B41J 11/002* (2013.01); *B41J 29/377* (2013.01)

(58) Field of Classification Search

CPC ..... G03G 15/108; G03G 15/11
USPC ..... 399/92–94, 237, 251; 430/105, 56
See application file for complete search history.

(56) References Cited

U.S. PATENT DOCUMENTS

| | | | | |
|---|---|---|---|---|
| 5,533,890 | A | 7/1996 | Holst et al. | |
| 5,555,813 | A | 9/1996 | Hale et al. | |
| 6,116,158 | A | 9/2000 | Demoore et al. | |
| 6,477,347 | B2 * | 11/2002 | Yokota et al. | 399/250 |
| 6,536,863 | B1 | 3/2003 | Beauchamp et al. | |
| 6,569,260 | B2 | 5/2003 | Rhodes | |
| 6,660,239 | B2 | 12/2003 | Nagji | |
| 6,681,497 | B2 | 1/2004 | Bria et al. | |
| 7,758,178 | B2 | 7/2010 | Saitoh et al. | |
| 2002/0118987 | A1 | 8/2002 | Takekoshi | |
| 2004/0118309 | A1 | 6/2004 | Fedor et al. | |
| 2005/0244184 | A1 * | 11/2005 | Kim et al. | 399/93 |
| 2006/0037854 | A1 | 2/2006 | Seorl et al. | |
| 2006/0093392 | A1 * | 5/2006 | Baker et al. | 399/93 |
| 2006/0133853 | A1 * | 6/2006 | Kim et al. | 399/251 |

(Continued)

FOREIGN PATENT DOCUMENTS

| | | | |
|---|---|---|---|
| EP | 116518 | A2 | 12/2001 |
| EP | 1502750 | B1 | 6/2009 |
| EP | 1442892 | B1 | 10/2009 |

OTHER PUBLICATIONS

PCT/US2010/055011 International Search Report dated Aug. 22, 2011.

(Continued)

*Primary Examiner* — Walter L Lindsay, Jr.
*Assistant Examiner* — Jessica L Eley

(57) ABSTRACT

A printer applies an imaging material to form an image, withdraws vapors from the applied imaging material and treats the withdrawn vapors with a vapor treatment system. The printer heats untreated withdrawn vapors with heat from the vapor treatment system.

11 Claims, 4 Drawing Sheets

(56) References Cited

U.S. PATENT DOCUMENTS

2007/0227382 A1 10/2007 Silverbrook et al.
2008/0290545 A1 11/2008 Tubbs
2009/0295894 A1 12/2009 Hori
2010/0097417 A1 4/2010 Hill

OTHER PUBLICATIONS

European Patent Office, Extended European Search Report, Mar. 18, 2014, Application No. 10859354.2, 8 pages.

* cited by examiner

PRINTER VAPOR TREATMENT PREHEATING

BACKGROUND

Printers sometimes form images by applying imaging materials that are wet and that may have solvents. The wet imaging material may produce undesirable vapors that should be neutralized.

DETAILED DESCRIPTION OF THE EXAMPLE EMBODIMENTS

Figure 1:
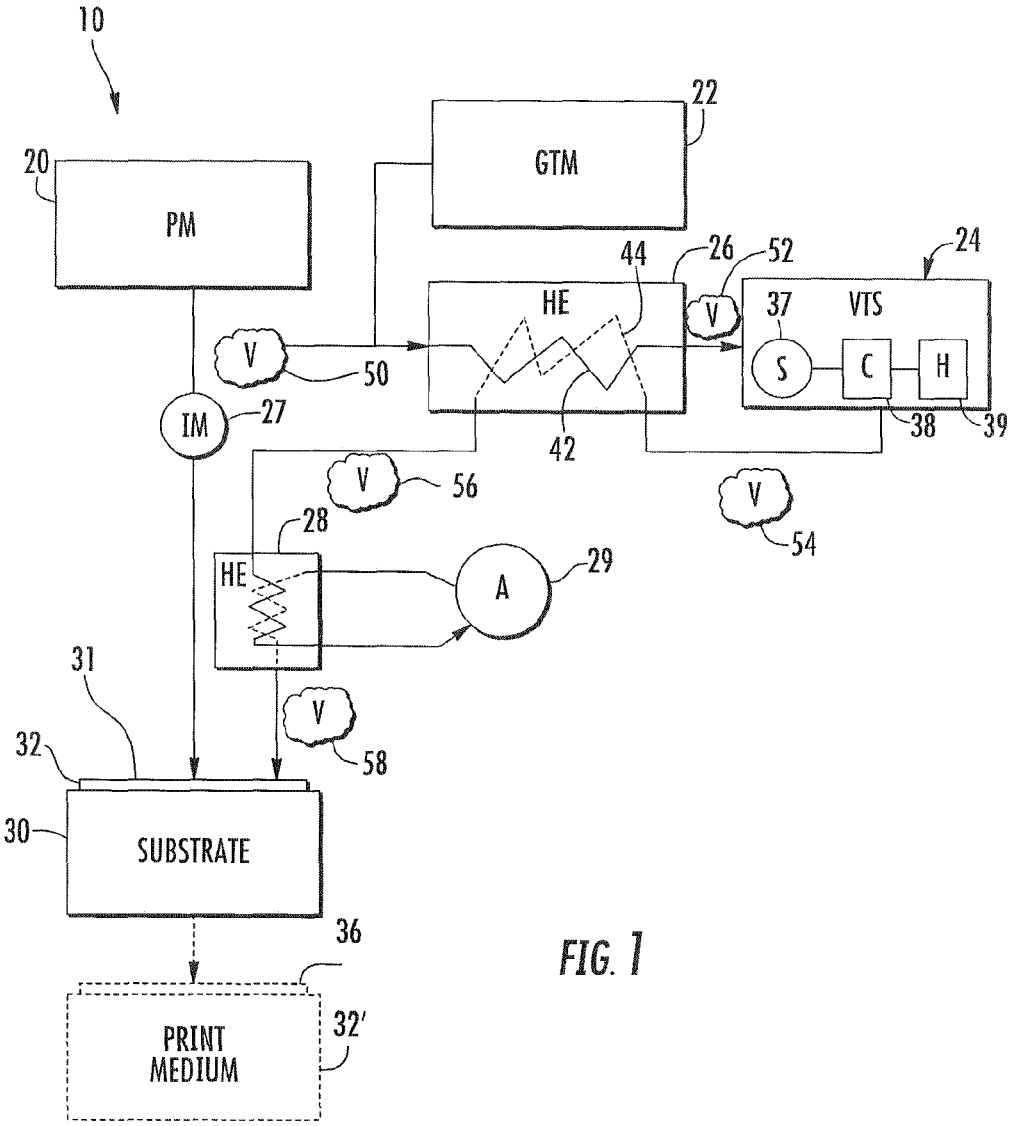
FIG. 1 is a schematic illustration of a printer according to an example embodiment.

FIG. 1 systematically illustrates a printing system or printer 10 according to an example embodiment. As will be described hereafter, printer 10 treats vapors resulting from printing and recycles heat from the vapor treatment to preheat untreated vapors to assist in their subsequent treatment. In one embodiment, printer 10 additionally recycles heat from the vapor treatment to heat imaging material applied on a substrate as an image. Because printer 10 recycles such heat, printer 10 is energy-efficient.

Printer 10 comprises print mechanism 20, gas transfer mechanism 22, vapor treatment system 24, heat exchanger 26 and heat exchanger 28. Print mechanism 20 comprises a device or mechanism configured to deposit, eject, form or otherwise apply imaging material 27 onto a substrate 30 in a print zone or region 31 so as to form an image or part of an image 32 on substrate 30. Examples of images 32 include, but are not limited to, alphanumeric text, patterns, photographs or graphics. Examples of imaging material 27 include, but are not limited to inks, toners or other liquids having one or more components within solvent or other liquids carrying particles, dyes or other elements.

According to one embodiment, substrate 30 may comprise a print medium which serves as a final destination for the printed image. Examples of a print medium include a web or sheet of medium such as a coated or uncoated cellulose-based medium or polymer-based medium. In other embodiments, substrate 30 may constitute an intermediate transfer member or surface, such as a drum or belt, wherein the image 32 formed by imaging material 27 on substrate 30 is subsequently transferred directly or transferred using additional intermediate transfer members to form a final image 32' on the final print medium 36 as shown in broken lines.

According to one embodiment, print mechanism 20 comprises one or more thermoresistive or piezoresistive printheads configured to eject or apply liquid imaging material onto substrate 30 to form image 32. In another embodiment, print mechanism 20 comprises a liquid electric photography (LEP) print mechanism. In still other embodiments, print mechanism 20 may comprise other devices configured to apply liquid imaging material to a substrate to form an image.

Gas transfer mechanism 22 comprises one or more devices and/or structures configured to urge and direct or guide flow of gas or vapors produced during the printing of image 32 (or 32') through heat exchanger 26 to vapor treatment system 24 and to further direct gas or vapor flow from vapor treatment system 24 through heat exchanger 26 to substrate 30. In one embodiment, gas transfer mechanism 22 comprises one or more blowers and one or more conduits or plenums, wherein the blowers urge the vapors through the conduits or plenums between print region 31, heat exchanger 26 and vapor treatment system 24.

Vapor treatment system 24 comprises a device or mechanism configured to treat vapors produced during the printing of image 32. Vapor treatment system 24 neutralizes or lessons a toxicity or harmfulness (human or environmental) of the vapors. Vapor treatment system 24 treats vapors at an elevated temperature (above room temperature). Vapor treatment system 24 receives untreated vapors from heat exchanger 26, treats the vapors and returns treated vapors to heat exchanger 26 for preheating the untreated vapors passing through heat exchanger 26 towards vapor treatment system 24.

In one embodiment, vapor treatment system 24 includes one or more temperature sensors 37, controller 38 and one or more heaters 39. Sensors 37 sense a temperature of the vapors prior to entering vapor treatment system 24 or while such vapors are being treated by vapor treatment system 24.

Controller 38 comprises one or more processing units configured to receive temperature feedback from sensor 37 and to control energy output of heaters 39 based upon such temperature feedback. Controller 38 adjusts the energy output of heaters 39 such that vapors within vapor treatment system 24 have a sufficiently elevated temperature for being treated. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 38 may be embodied as part of one or more application-specific integrated circuits (ASICs). Unless otherwise specifically noted, the controller is not limited to any specific combination of hardware circuitry and software, nor to any particular source for the instructions executed by the processing unit.

Heaters 39, under the control of controller 39, apply additional heat to the vapors such that the vapors have a sufficiently high temperature for effective treatment of the vapors by vapor treatment system 24. In one embodiment, vapor treatment system 24 treats the vapor by removing volatile organic compounds from the vapor. Examples of volatile organic compounds include, but are not limited to, pentane, ethanol, methanol, hexane, ethyl acetate and other solvent vaporizations or byproducts.

According to one embodiment, vapor treatment system 24 comprises a catalytic oxidation system (also known as a catalytic converter). In embodiments where vapor treatment system 24 comprises a catalytic oxidation system, vapor treatment system 24 includes a catalytic layer of metal catalysts such as platinum, palladium, platinum/rhenium and the like to oxidize the volatile organic compounds. The catalytic oxidation process has an operating temperature of at least about 170° C. for destruction efficiency of greater than 95% volatile organic compounds of Isopar vapors. In other embodiments, the operating temperature or inlet temperature for the catalytic oxidation process may be higher or lower depending upon the type and distribution of volatile organic compounds in the vapors being treated. In other embodiments, vapor treatment system 24 may comprise other systems for treating vapors in other manners, wherein a sufficiently high temperature of the vapor or a sufficiently high temperature of components of the vapor treatment system facilitates or enhances treatment of the vapors.

Heat exchanger 26 comprises a mechanism configured to thermally conduct or otherwise transfer heat from a first fluid to a second fluid while preventing direct contact of the first and second fluids. Heat exchanger 26 receives treated vapors 54 from vapor treatment system 24 at a higher temperature as compared to the untreated vapors 50 that heat exchanger 26 receives from print region 40. Heat exchanger 26 preheats the untreated vapors 50 from print region 40, using heat taken from the treated vapors, prior to the untreated vapors being transmitted to vapor treatment system 24. By recycling the heat from the treated vapors discharged from vapor treatment system 24 to preheat the untreated vapors, heat exchanger 26 reduces the amount of heat that is applied by heaters 39, increasing energy efficiency.

In the example illustrated, heat exchanger 26 comprises a pair of intertwined pipes or liquid conduits 42, 44 (schematically illustrated) in the form of coils, wherein the vapor from print region 40 flowing to vapor treatment system 24 flows through conduit 42 and wherein vapor discharged from vapor treatment system 24 flows through heat exchanger 26 through conduits 44 (shown in broken lines). Because the vapor flowing through conduit 44 is at a higher temperature as compared to the vapor flowing through conduit 42 in heat exchanger 26, heat is thermally conduct from conduit 42 to conduit 44 to preheat vapor within conduit 44. In one embodiment, conduits 42 and 44 may be formed from copper or other highly thermally conductive materials. In other embodiments, heat exchanger 26 may have other configurations. For example, in other embodiments, heat exchanger 26 may use a phase transition of an intermediate material to pass heat from one fluid to another.

Heat exchange 28 is structurally identical to heat changer 26 except that heat exchanger 28 receives vapors 56 discharged from heat changer 26 and conducts or otherwise transfers the heat from vapor 56 to air or other gases being supplied to or directed at image 32 upon substrate 30. In the example illustrated, papers 56 from heat exchanger 26 pass through heat exchanger 28 and are discharged to atmosphere 29. At the same time, air from atmosphere 29 is drawn through heat changer 28, is heated within heat changer 28, and is supplied to image 32 to assist in volatizing vapors from image 32. As a result, the treated vapors 54 that are discharged from vapor treatment system 24 is further recycled to volatizing vapors from image 32 to further reduce energy consumption.

According to one embodiment, the air from atmosphere 29 is drawn through heat exchanger 28 at a rate less than the rate at which vapors 50 are drawn from the print region 31 such that a vacuum or lower pressure region remains in print region 31. Consequently, any leaks in printer 10 merely result in their atmosphere being drawn into printer 10 rather than untreated vapors leaking out of printer 10. Although printer 10 is illustrated as discharging the treated vapors 56 from heat exchanger 28 to atmosphere 29, in other embodiments, heat changer 28 may discharged gas or vapors to other treatment systems or to a containment system. In yet other embodiments, heat exchanger 28 may be omitted, wherein treated vapors 56 are directly supplied to image 32 upon substrate 30 without passing through any intermediate heat exchangers.

Figure 2:
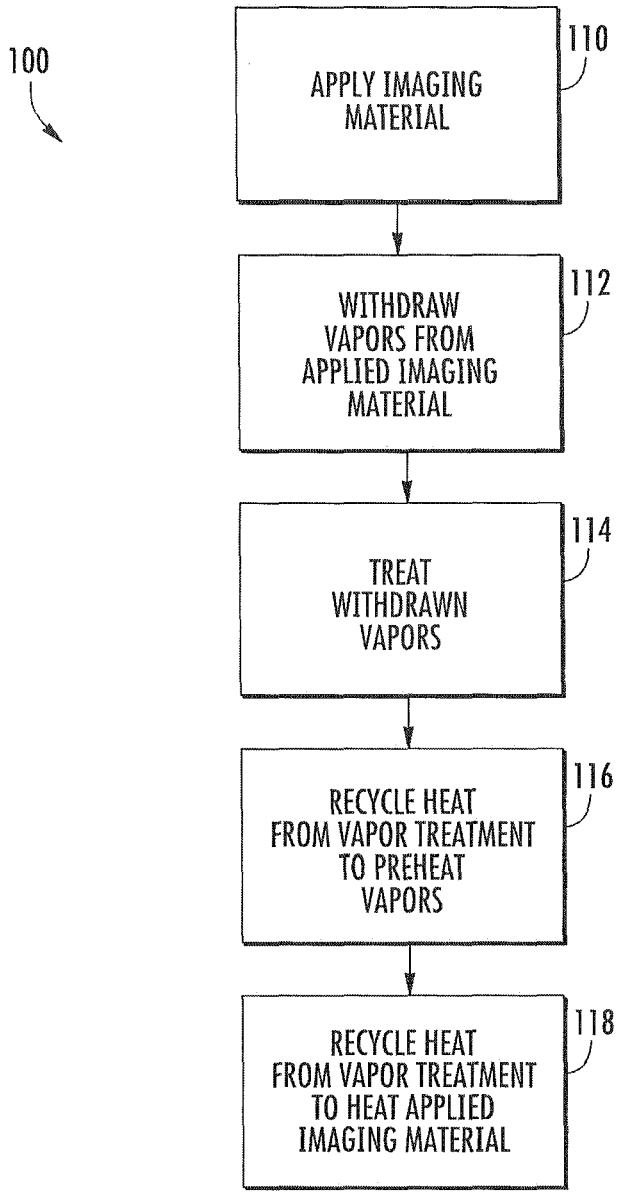
FIG. 2 is a flow diagram of a method of treating vapors according to an example embodiment.

FIG. 2 is a flow diagram illustrating an example printing method or process 100 that may be performed by printer 10 shown in FIG. 1. As shown by FIG. 2, in step 110, print mechanism 20 of printer 10 (shown in 1) applies imaging material 27 to substrate 30 to form an image 32 upon a surface of substrate 30. During the application or during heating of imaging material 27 on substrate 30, untreated vapors 50 are generated or produced in print region 40.

As indicated by step 112, gas transfer mechanism 22 draws the untreated vapors 50 away from print region 40 and away from image 32 through conduit 42 of the exchanger 26 towards vapor treatment system 24. In one embodiment, gas transfer mechanism 22 may apply a negative pressure to print region 31 to draw vapor 50 into conduit 42 of exchanger 26 which is at a higher pressure. In one embodiment, gas transfer mechanism 22 utilizes one more fans or blowers to create the pressure differential for drawing vapors 50 into conduit 42 of heat exchanger 26 and towards vapor treatment system 24.

As indicated by step 114 in FIG. 2, vapor treatment system 24 receives and treats vapors 52 that have passed through heat exchanger 26. Vapor treatment system 24 treats vapors 52 using one or more treatment techniques that treat vapor 52 when vapors 52 (or components of vapor treatment system 24 in thermal contact with vapor 52) have a sufficiently high temperature. In one embodiment, vapor treatment system 24 senses a temperature of vapors 52 just before entering vapor treatment system 24 or while within vapor treatment system 24. Based on the sensed temperature feedback, vapor treatment system 24 applies heat (using one or more heating devices 39) to vapors 52 such that vapors 52 have a sufficiently high temperature for treatment.

As mentioned above, in one embodiment, vapor treatment system 24 reduces or neutralizes toxicity or harmfulness of vapors 52. In one embodiment, vapor treatment system 24 removes volatile organic compounds from vapors 52. In yet other embodiments, vapor treatment system 24 may treat vapors 52 in other manners by altering other chemical characteristics of vapors 52. As shown by FIG. 1, vapor treatment system 24 discharges treated vapors 54. Because the process used to treat vapors 52 is performed at an elevated temperature or may itself raise the temperature of the vapors, treated vapors 54 exit vapor treatment system 24 at an elevated temperature.

As indicated by step 116 of FIG. 2, heat exchanger 26 (shown in FIG. 1) recycles heat from the vapor treatment of vapor treatment system 24 to preheat vapors 50 passing through conduit 42. In particular, heat exchanger 26 receives vapors 54 which are at a temperature greater than the temperature of vapors 50 also received by heat exchanger 26. Heat exchanger 26 thermally conducts heat from vapors 54 to vapors 50 to preheat vapors 50 such that vapors 52 have a temperature greater than vapors 50 prior to entering vapor treatment system 24. Because vapors 52 are preheated to have a temperature greater than that of vapors 50 using the heat recycled from vapors 54, vapor treatment system 24 may treat vapors 52 with less heat being applied by heaters 39.

As indicated by step 118 of the method 100 of FIG. 2, gas transfer mechanism 22 further directs vapors 56 discharged from the exchanger 26 through heat exchanger 48 to heat the air used to dry the image 32. As noted above, in one embodiment, substrate 30 may comprise the actual print medium. In another embodiment, substrate 30 may comprise an intermediate transfer member. Although vapors 56 may have a temperature less than that of vapors 54, vapors 56 have a temperature sufficiently high to assist in heating the air used to volatize vapors from the wet imaging material 27 forming image 32 on substrate 30. As a result, sufficient drying of the wet imaging material 27 forming image 32 on substrate 30 may be completed in less time and with less additional energy. According to one embodiment, vapors 50 have a temperature in the range of 30 to 40 degrees Celsius (the temperature of the print mechanism (the press) with some heat contribution from a blower of the gas transfer mechanism) prior to being preheated by heat exchanger 26 and are directed by gas transfer mechanism 22 through heat exchanger 26 at a rate of about 30 liters per second to overcome potential leaks. Vapors 52, which have been preheated by heat exchanger 26 using heat recycled from vapors 54, have a temperature of between about 70 and 80 degrees Celsius and are directed through or across vapor treatment system 24 (comprising a catalytic oxidation system or catalytic converter). In such an embodiment, vapor treatment system 24 sufficiently treats vapors 52 when vapors 52 have a temperature of at least 170 degrees Celsius. Vapors 54 being discharged from vapor treatment system 24 have a temperature of between 170 and 240 degrees Celsius (depending upon vapor concentration) prior to entering heat exchanger 26. Vapors 58 have a temperature of between 50 and 60 degrees Celsius when being directed at the wet imaging material 27 forming image 32 on substrate 30. In other embodiments, vapors 50, 52, 54, 56 and 58, at the different stages of heat recycling, may have different temperatures depending upon the characteristics of the print mechanism 20, heat exchanger 26, heat exchanger 28 and vapor treatment system 24. In still other embodiments, step 118 and the recycling of heat to heat imaging material 27 may be omitted, wherein the treated vapors 56 discharged from heat exchanger 26 are used to heat other materials or structures or are contained or discharged to atmosphere.

Figure 3:
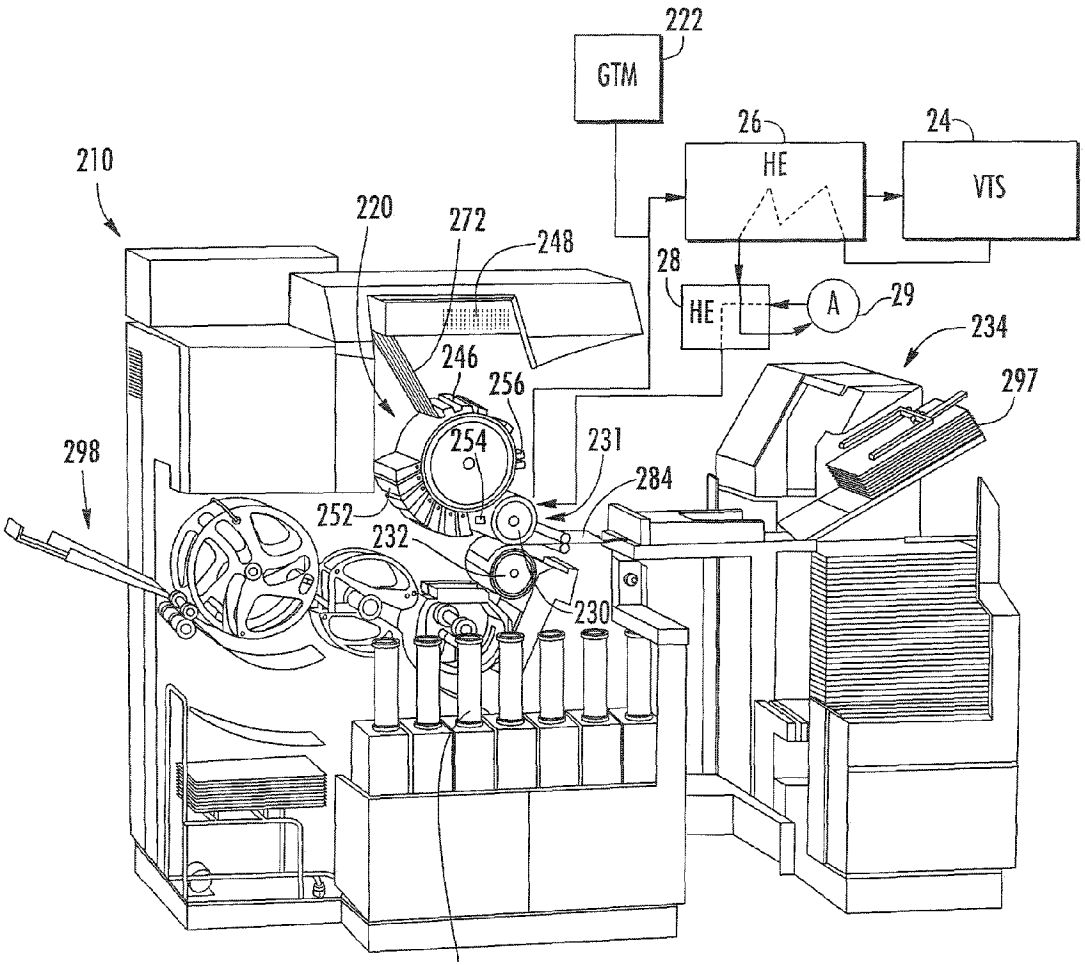
FIG. 3 is a perspective view of a particular embodiment of the printer of FIG. 1 according to an example embodiment, with portions schematically shown.
Figure 4:
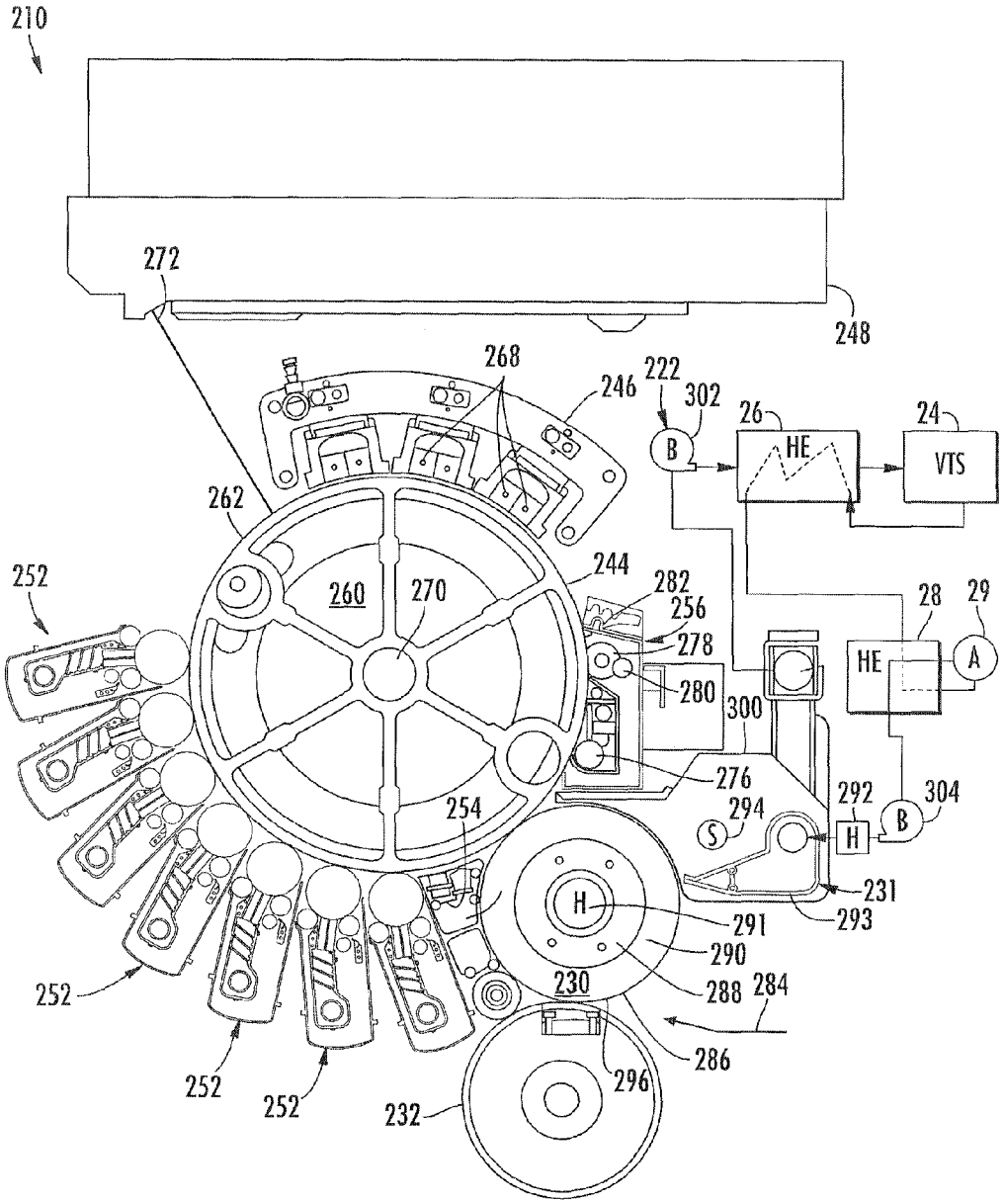
FIG. 4 is a sectional view of a portion of the printer of FIG. 3 according to an example embodiment, with portions schematically shown.

FIGS. 3 and 4 illustrate printer 210, an example embodiment of printer 10 schematically shown in FIG. 1. In the example illustrated, printer 210 utilizes a liquid electro-photographic (LEP) process. Printer 210 comprises print mechanism 220, intermediate transfer member 230, impression cylinder 232, media transport system 234, gas transfer mechanism 222, vapor treatment system 24, heat exchanger 26 and heat exchanger 28.

Print mechanism 220 comprises a device or mechanism configured to deposit, eject, form or otherwise apply imaging material onto intermediate transfer member 230 (serving as the substrate 30 shown in FIG. 1) in a print zone or region 231 so as to form an image or part of an image on intermediate transfer member 230. Print mechanism 220 comprises photoconductor 244, charger 246, imager 248, ink or toner supplies 250, developers 252, charge eraser 254 and photoconductor cleaning station 256. Photoconductor 244 generally comprises a cylindrical drum 260 supporting an electrophotographic surface 262, sometimes referred to as a photo imaging plate (PIP). Electrophotographic surface 262 comprises a surface configured to be electrostatically charged and to be selectively discharged upon receiving light from imager 248. Although surface 262 is illustrated as being supported by drum 260, surface 262 may alternatively be provided as part of an endless belt supported by a plurality of rollers. In such an embodiment, the exterior surface of the endless belt may be configured to be electrostatically charged and to be selectively discharged for creating an electrostatic field in the form of an image.

Charger 246 comprises a device configured to electrostatically charge surface 262. In the particular example shown, charger 246 includes 6 corotrons or scorotrons 268. In other embodiments, other devices for electrostatically charging surface 262 may be employed.

Imager 248 generally comprises any device configured to direct light upon surface 262 so as to form an image. In the example shown, imager 268 comprises a scanning laser which is moved across surface 262 as photoconductor 244 is rotated about axis 270. Those portions of surface 262 which are impinged by the light or laser 272 become electrically conductive and discharge electrostatic charge to form an image (and latent image) upon surface 262.

Although imager 248 is illustrated and described as comprising a scanning laser, imager 248 may alternatively comprise other devices configured to selectively emit or selectively allow light to impinge upon surface 262. For example, in other embodiments, imager 248 may alternatively include one or more shutter devices which employ liquid crystal materials to selectively block light and to selectively allow light to pass through to surface 262. In other embodiments, imager 248 may alternatively include shutters which include individual micro or nano light blocking shutters which pivot, slide or otherwise physically move between the light blocking and light transmitting states.

In still other embodiments, surface 262 may alternatively comprise an electrophotographic surface including an array of individual pixels configured to be selectively charged or selectively discharged using an array of switching mechanisms such as transistors or metal-insulator-metal (MIM) devices forming an active array or a passive array for the array of pixels. In such an embodiment, charger 246 may be omitted.

Ink or toner supplies 250 comprise containers connected to developers 252 to supply imaging material (ink or toner) to developers 252. In the particular example shown, the imaging material generally comprises a liquid or fluid ink comprising a liquid carrier and colorant particles. The colorant particles may have a size of less than 2 microns, although other sizes may be employed in other embodiments. In the example illustrated, the imaging material generally includes up to 6% by weight, and nominally 2% by weight, colorant particles or solids prior to being applied to surface 262. In one embodiment, the colorant particles include a toner binder resin comprising hot melt adhesive. In one particular embodiment, the imaging material comprises HEWLETT-PACKARD ELECTRO INK commercially available from Hewlett-Packard. In other embodiments, the imaging material may comprise other materials.

Developers 252 (known as binary ink developers or BIDs) comprise devices configured to apply the imaging material to surface 262 based upon the electrostatic charge upon surface 262 and to develop the image upon surface 262. In the example illustrated, each developer uses a roller to apply a charged imaging material to surface 262. In other embodiment, developers 252 may have other configurations.

Charge eraser 254 comprises a device situated along surface 262 and configured to remove residual charge from surface 262. In one embodiment, charge eraser 262 may comprise an LED erase lamp. In particular embodiments, eraser 252 may comprise other devices or may be omitted.

Cleaning station 256 is arranged proximate to surface 262 between the intermediate transfer member 230 and charger 246. Cleaning station 256 comprises one or more devices configured to remove residual ink and electrical charge from surface 262. In particular examples shown, cleaning station 256 directs a cooled liquid, such as a carrier liquid, across surface 262 between rollers 276, 278. Adhered toner particles are removed by roller 278, which is absorbent. Particles and liquids picked up by the absorbent material of roller 278 are squeegeed out by a squeegee roller 280. The cleaning process of surface 262 is completed by station 256 using a scraper blade 282 which scrapes any remaining toner or ink from surface 262 and keeps the carrier liquid from leaving cleaning station 256. In other embodiments, other cleaning stations may be employed or cleaning station 256 may be omitted.

Intermediate transfer member 230 comprises a member configured to transfer printing material from surface 262 to print medium 284 (shown in FIG. 3). Intermediate transfer member 230 includes an exterior surface 286 which is resiliently compressible and which is configured to be electrostatically charged. Because surface 286 is resiliently compressible, surface 286 conforms and adapts to irregularities on print medium 284. Because surface 286 is configured to be electrostatically charged, surface 286 may be charged to a voltage so as to facilitate transfer of printing material from surface 262 to surface 286.

In the particular embodiment shown, intermediate transfer member 230 includes drum 288 and an external blanket 290 which provides surface 286. Drum 288 generally comprises a cylinder that supports blanket 290. In one embodiment, drum 288 is formed from a thermally conductive material, such as a metal like aluminum. In such an embodiment, drum 288 houses an internal heater 291 (schematically shown) which heats surface 286 to melt the imaging material.

Blanket 290 wraps about drum 288 and provides surface 286. In one particular embodiment, blanket 290 is adhered to drum 288. Blanket 290 includes one or more resiliently compressible layers and includes one or more electrically conductive layers, enabling surface 286 to conform to and to be electrostatically charged. Although intermediate transfer member 230 is illustrated as comprising drum 288 supporting blanket 290 which provides surface 286, intermediate transfer member 230 may alternatively comprise an endless belt supported by a plurality of rollers in contact or in close proximity to surface 262 and impression cylinder 232.

Dryer 231 comprises one or more devices configured to facilitate partial drying of imaging material upon surface 286. Dryer 232 is arranged about intermediate transfer member 230 and includes heater 292, gas director 293 and sensor 294. Gas director 293 comprises a chamber having an exit slit configured to direct air heated by heater 292 towards surface 286 to dry imaging material by volatizing vapors from imaging material. In other embodiments, gas director may be omitted or may have other configurations.

Sensor 294 comprises one or more sensors configured to sense a temperature of gas being directed towards surface 286 and the temperature of gas about surface 286. Alternatively, sensor 286 may be configured to sense a dryness of the imaging material. Based on feedback from sensor 294, heater 292, under the control of a controller comprising a processing unit (not shown), increases or decreases heat being applied to achieve sufficient drying and energy conservation.

Impression cylinder 232 comprises a cylinder adjacent to intermediate transfer member 230 so as to form a nip 294 between member 230 and cylinder 232. Media 284 is generally fed between intermediate transfer member 230 and impression cylinder 232, wherein imaging material is transferred from intermediate transfer member 230 to medium 284 at nip 296. Although impression member 232 is illustrated as a cylinder or roller, impression member 232 may alternatively comprise an endless belt or a stationary surface against which intermediate transfer member 230 moves.

Media transport 234 (shown in FIG. 3) delivers print media 284 to nip 296 where images for imaging material on surface 286 of intermediate transfer member 230 are transferred to media 284. In the example illustrated, media transport 234 is configured to transport individual sheets of media from a stack 297 across nip 296 and then from nip 296 to an output 298. In other embodiments, media transport 234 may alternatively be configured to transport a web of media 284 across nip 296.

Gas transfer mechanism 122 comprises one or more devices and/or structures configured to urge and direct or guide the flow of gas or vapors produced during the printing of image upon intermediate transfer mechanism 230 through heat exchanger 26 to vapor treatment system 24 and to further direct gas or vapor flow from vapor treatment system 24 through heat exchanger 26 to member 230. In the example illustrated, gas transfer mechanism 122 comprises chamber 300 and blowers 302, 304. Chamber 300 extends partially about surface 286 of intermediate transfer member 230 between photoconductor 244 and impression cylinder 232. Chamber 300 is in pneumatic communication or is pneumatically connected to blower 302 such that a vacuum may be created within chamber 300 by blower 302 to draw vapors, released during drying of the wet imaging material, towards heat exchanger 26. In other embodiments, chamber 300 may have other shapes or configurations defined by other walls or structures.

Blower 302 creates a vacuum within chamber 300 and draw vapors to heat exchanger 26. At the same time, blower 304 draws and directs vapors discharged by heat exchanger 26 through or past heater 292 to gas director 293. As a result, the treated heated vapors discharged from heat exchanger 26 assist in drying or volatizing solvents of imaging material upon surface 286 of intermediate transfer member 230. As a result, sufficient drying of the wet imaging material forming the image on surface 286 may be completed in less time and with less additional energy.

Vapor treatment system 24 and heat exchanger 26 of printer 210 are identical to heat exchanger 26 and vapor treatment system 24 described above with respect to printer 10. As noted above, vapor treatment system 24 treats vapors when such vapors are at a sufficiently high temperature. In the example illustrated, vapor treatment system 24 employs a catalytic oxidation process which itself increases the temperature of the vapors being treated by up to 70 degrees Celsius. Heat exchanger 26 receives the treated vapors at the elevated temperature and thermally conducts or transfers heat from the treated vapors to yet untreated vapors about to enter vapor treatment system 24. Heat exchanger 26 recycles heat from the treated vapors to pre-heat such untreated vapors such that vapor treatment system 24 may treat the vapors using less heat or less energy. Heat exchanger 28 receives the treated vapors at the elevated temperature from heat exchanger 26 and thermally conducts or transfers heat from the treated vapors to air supplied to the image upon intermediate transfer member 230. Heat exchanger 28 recycles heat from the treated vapors such that printer 210 may dry the image upon member 230 using less heat or less energy.

In operation, charger 246 electrostatically charges surface 262. Surface 262 is exposed to light from imager 248. In particular, surface 262 is exposed to laser 272 which is controlled by a raster image processor that converts instructions from a digital file into on/off instructions for laser 272. This results in a latent image being formed for those electrostatically discharged portions of surface 262. Ink developers 252 develop an image upon surface 262 by applying ink to those portions of surface 262 that remain electrostatically charged.

Once an image upon surface 262 has been developed, eraser 254 erases any remaining electrical charge upon surface 262 and the ink image is transferred to surface 286 of intermediate transfer member 230. Thereafter, any remaining imaging material on surface 262 is removed by cleaning station 256. In the embodiment shown, the imaging material forms an approximately 1.4 micron thick layer of approximately 85% solids colorant particles with relatively good cohesive strength upon surface 286.

Once the printing material has been transferred to surface 286, heat is applied to the imaging material on surface 86 so as to melt toner binder resin of the colorant particles or solids of printing material 54 to form a hot melted adhesive. Dryer 231 partially dries the melted liquid colorant particles to volatize and release solvent or other vapors from the imaging material.

The released vapors are drawn through heat exchanger 26 where they are preheated using heat recycled from treated vapors. The preheated vapors are then treated by vapor treatment system 24 and directed through heat exchanger. After preheating the untreated vapors passing through heat exchanger 26, the treated vapors are directed by blower 304 to heat exchanger 28 which uses the heat to heat the air being directed by gas director 293 of dryer 231.

After sufficient drying by dryer 231, the layer of melted colorant particles forming an image upon surface 286 are transferred to media 284 passing between transfer member 230 and impression cylinder 232. In the embodiment shown, the melted colorant particles are transferred to print media 284 at approximately 90 degrees Celsius. The layer of melted colorant particles freeze to media 284 on contact in the nip 296 formed between intermediate transfer member 230 and impression cylinder 232.

These operations are repeated for every color for preparation in the final image to be produced. In other embodiments, in lieu of creating one color separation at a time on surface 286, sometimes referred to as "multi-shot" process, the above-noted process may be modified to employ a one-shot color process in which all color separations are layered upon surface 286 of intermediate transfer member 230 prior to being transferred to and deposited upon medium 284.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printer comprising:

a printing mechanism configured to apply an imaging material to a substrate;

a vapor treatment system;

a first heat exchanger configured to receive treated vapors from the vapor treatment system;

a gas transfer mechanism configured to transfer vapors from a region proximate the printing mechanism through the first heat exchanger, where untreated vapors are preheated using treated vapors from the vapor treatment system, and then to the vapor treatment system; and a second heat exchanger configured to receive treated vapors from the first heat exchanger and to supply heat to the imaging material that has been applied by the printing mechanism.

2. The printer of claim 1, wherein the vapor treatment system is configured to remove volatile organic compounds from the vapor.

3. The printer of claim 1, wherein the vapor treatment system comprises a catalytic oxidation system.

4. The printer of claim 1 further comprising an intermediate transfer member configured to carry the imaging material formed in the image, whereby the image is subsequently transferred to a print medium, and wherein the gas transfer mechanism is configured to direct vapors from the vapor treatment system, after the vapors have passed through the heat exchanger, towards the intermediate transfer member to volatize vapors from the imaging material on the intermediate transfer member.

5. The printer of claim 4, wherein the intermediate transfer member comprises a drum having a compressible blanket.

6. A method comprising:

applying an imaging material to a substrate;

withdrawing vapors from the applied imaging material;

treating the withdrawn vapors with a vapor treatment system;

heating untreated withdrawn vapors with heat from the vapor treatment system; and recycling heat from the vapor treatment system to heat imaging material applied as the image.

7. The method of claim 6, wherein the recycling comprises directing withdrawn vapors that have been treated through a heat exchanger in contact with the withdrawn vapors that have not yet been treated.

8. The method of claim 6, wherein the withdrawn vapors are treated with a catalytic oxidation system.

9. The method of claim 6, wherein treating the withdrawn vapors includes removing volatile organic compounds from the vapors.

10. The method of claim 6, wherein treating the withdrawn vapors includes neutralizing toxicity or harmfulness of the withdrawn vapors.

11. A printer comprising:

a printing mechanism configured to apply an imaging material to a substrate, the printing system comprising an intermediate transfer member configured to carry the imaging material, whereby the imaging material is subsequently transferred to a print medium;

a vapor treatment system;

a heat exchanger configured to receive vapors from the vapor treatment system; and a gas transfer mechanism configured to draw vapors from a region proximate the printing mechanism through the heat exchanger and to the vapor treatment system, where untreated vapors are preheated in the heat exchanger using treated vapors from the vapor treatment system and wherein the gas transfer mechanism is configured to direct vapors from the vapor treatment system, after the vapors have passed through the heat exchanger, for use in volatizing vapors from the imaging material on the intermediate transfer member.

* * * * *

UNITED STATES PATENT AND TRADEMARK OFFICE

CERTIFICATE OF CORRECTION

PATENT NO. : 9,025,990 B2
APPLICATION NO. : 13/879666
DATED : May 5, 2015
INVENTOR(S) : Doron Schlumm et al.

It is certified that error appears in the above-identified patent and that said Letters Patent is hereby corrected as shown below:

Title page, item (75), Inventors, in column 1, line 2, delete "Gan Yavna" and insert -- Gan Yavne --, therefor.

Signed and Sealed this
Twenty-first Day of June, 2016

Michelle K. Lee

Michelle K. Lee
*Director of the United States Patent and Trademark Office*